United States Patent [19]

Aparicio

[11] Patent Number: 4,527,031

[45] Date of Patent: Jul. 2, 1985

[54] ELECTROMECHANICAL SYSTEM FOR GENERATING HEAT IN METALLIC VESSELS

[76] Inventor: Luis R. Aparicio, Gran Via, 57, Madrid-13, Spain

[21] Appl. No.: 620,065

[22] Filed: Jun. 13, 1984

[51] Int. Cl.[3] ..... H05B 6/12

[52] U.S. Cl. ..... 219/10.49 R; 219/10.79; 219/10.67; 219/10.75; 219/434; 219/518; 126/390; 99/DIG. 14

[58] Field of Search ..... 219/10.49 R, 10.79, 219/10.67, 10.75, 10.57, 10.51, 432, 433, 434, 518; 126/390; 99/DIG. 14

[56] References Cited

U.S. PATENT DOCUMENTS

| | | | |
|---|---|---|---|
| 891,657 | 6/1908 | Berry | 219/10.49 R |
| 932,242 | 8/1909 | Berry | 219/10.75 X |
| 3,530,499 | 9/1970 | Schroeder | 219/10.51 X |
| 4,303,816 | 12/1981 | Goessler et al. | 219/10.49 R |
| 4,311,896 | 1/1982 | Junya | 219/10.67 X |

*Primary Examiner*—Philip H. Leung
*Attorney, Agent, or Firm*—Mason, Kolehmainen, Rathburn & Wyss

[57] ABSTRACT

An electromechanical system for generating heat in metallic vessels, includes a vessel which acts as a load resistance for the secondary of a transformer having a very low voltage and a high current. The voltage developed in the secondary of the transformer is applied directly to the vessel between two diametrically opposed areas comprising contact members on the vessel. Electrodes are engaged to press against the contact members and the electrodes are connected to the terminals of the secondary of the transformer. The system includes a mechanism for controlling the distance between the electrodes for separating the electrodes from the contact members on the vessel in order to remove or place the vessel between the electrodes and for moving the electrodes closer together with strong pressure against the contact members on the vessel for closing the electric circuit of the secondary. Immediately after a vessel is in place and pressure contact is established between the electrodes and the contact members of the vessel, the primary of the transformer is energized to establish a flow of high current, low voltage electricity in the secondary to pass directly through the material of the vessel between the contact members to heat the vessel and the contents therein.

11 Claims, 3 Drawing Figures

ELECTROMECHANICAL SYSTEM FOR GENERATING HEAT IN METALLIC VESSELS

BACKGROUND OF THE INVENTION

1. Field of the Invention

This invention relates to a new electromechanical system for generating heat in metallic vessels, by means of which it is possible to instantly change all the electrical energy consumed, into useful heat, directly within the metal from which the vessel is made.

2. Description of The Prior Art

In conventional systems used to heat vessels, an external generator of heat has been used and this external heat is transmitted as heat to the vessel that is being heated. Aside from the inconveniences intrinisic to these old systems, such as, requiring temperatures four or more times higher than the temperature needed in the vessel, or the possible burning out of the resistor in electric heaters, or accidents in the event fuels are used, the main defect of external heat sources arises from the low energy efficiency. In the case of electric heaters, a large amount of the electrical energy consumed, is lost by raising the temperature of the mass of the heating element, overcoming the losses produced by the insulation and in radiation. The latter heat loss, as well as thermal dispersion, likewise affects heaters that burn fuels.

OBJECTS OF THE INVENTION

In accordance with the system described herein, it is an object of the present invention, to eliminate the aforementioned typical defects of conventional systems used for heating vessels. The system of the present invention does not use a process of transferring of thermal energy, but rather, the thermal energy is directly generated within the material that the vessel is made out of, by a high current circulated through the metal.

SUMMARY OF THE PRESENT INVENTION

The vessel used in the system the present invention is formed of conductive metal because an electric current is circulated directly through the metal, and the resistivity of the material that forms the vessel has to be high enough so that the high current electricity that circulates, changes entirely into heat. Stainless steel or another similar alloy is an example of suitable material. The voltage required to generate heat in the vessel is obtained from the secondary of a transformer, and the voltage is applied to the vessel between two opposite points or areas comprising contact members. Two highly conductive, concave, external electrodes are pressed tightly against the contact members of the vessel and the electrodes have a radius which is the same radius as that of the contact members on the vessel.

For a specific value of electrical power to be turned into heat, the voltage applied to the vessel will depend on the ohmic value of the load, i.e. the resistance of the vessel. Normally the ohmic value of the vessel is generally in the neighborhood of several micro-ohms, and the voltage applied is likewise low, i.e.: around 1 volt.

Even when the coupling or the pressure contact between the external electrodes and the contact members on the like vessel, is accomplished in a rather precise manner, imperfections of contact between the highly conductive electrodes and the material having highest resistivity of the vessel can always appear in mass production processes, thus producing points or centers of high temperature even in the areas of best contact. These imperfections can end up "burning" the material of the vessel in these areas.

In accordance with the present invention, the aforementioned contact defects have been eliminated by covering the areas on the vessel against which the electrodes are pressed with contact members having a circular piece or segment formed of a highly conductive material. These conductive contact members are welded to the vessel over the entire area of electrode contact, so that the resistance across the electric contact between the conductive contact members and the material of the vessel is extremely low. In this way, a uniform flow of the current over the entire surface of the welding area and on the contacting surface of the vessel is assured. The conductive contact members can be varied in size to vary the load resistance across the vessel and as a result, the amount of power consumed.

Because the vessel itself is a carrier of electric current and acts as a load resistance due to its resistivity, the conductive contact members act as a short circuit at opposite ends of said resistance over the entire area of welded contact. It is evident that a reduction of the short circuited area will result in an increase of resistance and vice versa. Nevertheless, the thermal energy built up in the vessel is preferably generated in the bottom of the same and for this purpose it is necessary that the electric current passing through the vessel be adequately distributed between the bottom and the vertical walls.

The ohmic resistance of the bottom of the vessel is lower than the ohmic resistance of the vertical walls of the vessel. This condition is met in a vessel whose bottom and body are formed of metal of the same thickness, and wherein the conductive contact members welded to the vessel extend around the circumference of the vessel through an angle of approximately 45°.

For the purpose of assuring a low resistance contact between the external electrodes and the contact members on the vessel, the area of contact is subjected to a heavy pressure, which can be produced by means of strong springs that force the electrodes toward each other. This pressure can likewise be created by means such as leaf springs, hydraulic pistons, etc.

The mechanical system of the embodiment of the present invention herein described includes springs as sources of pressure and a mechanism for relieving the compressing action of the springs by forcing the electrodes to separate, so that the vessel may be conveniently placed or lodged between the electrodes and subsequently removed. The mechanism, includes an eccentrically shaped cam, spindle, helicoid, etc., rotatable in reversible directions, thus making it possible, for controlling the spring pressure acting to compress the electrodes against the contact members of the vessel.

When the vessel has been clamped between the electrodes and therefore immobilized and ready to receive the electric heating current, a lever mechanism reaches an end of stroke position, which results in closing an electric circuit of the primary of the transformer, to begin the heating process.

BRIEF DESCRIPTION OF THE DRAWING

The features and advantages of the present invention including an electromechanical system in accordance with the objects of the present invention will be understood better by analyzing the sheet of drawings that is appended hereto and with reference to the following detailed description herein- after.

BRIEF DESCRIPTION OF A PREFERRED EMBODIMENT

Figure 1:
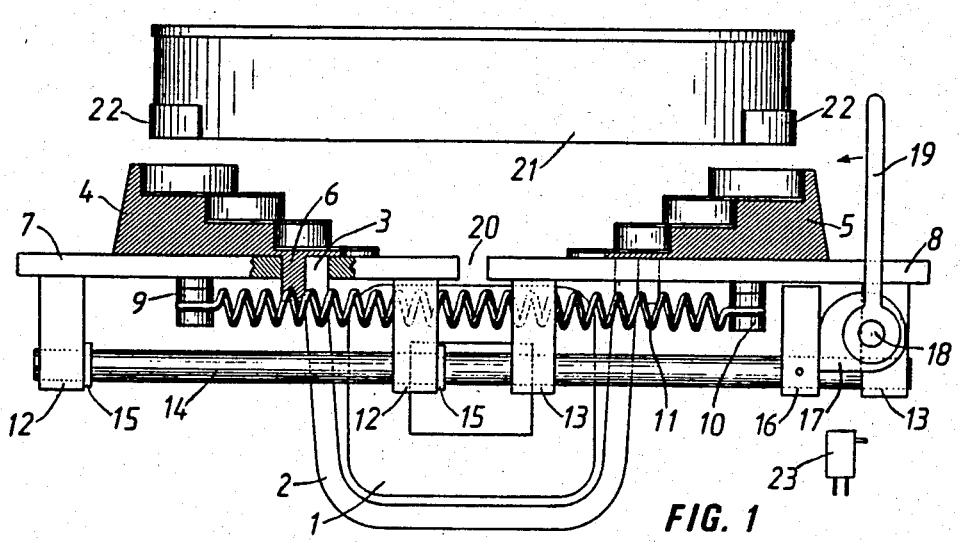
FIG. 1 represents a simplified elevation view of a vessel and electromechanical system in accordance with the invention in which electrodes are separated and in an open position ready to receive or hold the vessel which is to be heated.

In FIG. 1 is illustrated a primary winding of a feeder transformer 1 having a high current, low voltage secondary 2 and the customary magnetic core has been omitted for greater clarity. Terminals 3 of the secondary 2 are welded or rigidly fastened to projections 6 on electrodes 4 and 5 which are fastened to support plates 7 and 8, respectively. These plates provide support for other components of the mechanical system including a depending coupling pin 9, a draw spring 11 and bearings 12 for a guide bar 14 supported from the plate 7, and, a coupling pin 10 connected to the draw spring 11, bearings 13 for the guide bar 14 and a control bar or shaft 18, supported from the plate 8. The guide bar 14 serves to guide reversible reciprocal motion of the support plates 7 and 8 and the components that are fastened thereto.

A support piece 16 is fixedly mounted on the guide bar 14 to be engaged by an eccentric cam 17 mounted on a control bar or shaft 18. The shaft 18 is rotated by a lever 19 to move the cam against the support piece 16. In FIG. 1, the eccentric cam 17 is shown in a position after the cam has produced movement of the support piece 16 towards the left as shown in the drawing and this movement provides simultaneous leftward movement of the guide bar 14. The guide bar 14 is movable freely in the bearings 13 but is not movable with respect to the bearings 12 because of collars 15 which are mounted on the guide bar 14 to prevent such relative movement. When the eccentric cam 17 is rotated to move the support piece 16 and the guide bar 14 to the left relative to the bearings 12, the coupling pin 9 connected to the left hand end of the spring 11, the support plate 7 and the electrode 4 likewise move to the left, creating enough space 20 so that a vessel 21 can be placed between the electrodes 4 and 5. In this open position, the eccentric cam 17 has overcome the primary action of the draw spring 11, and the spring is stretched or extended beyond its normal length.

Figure 2:
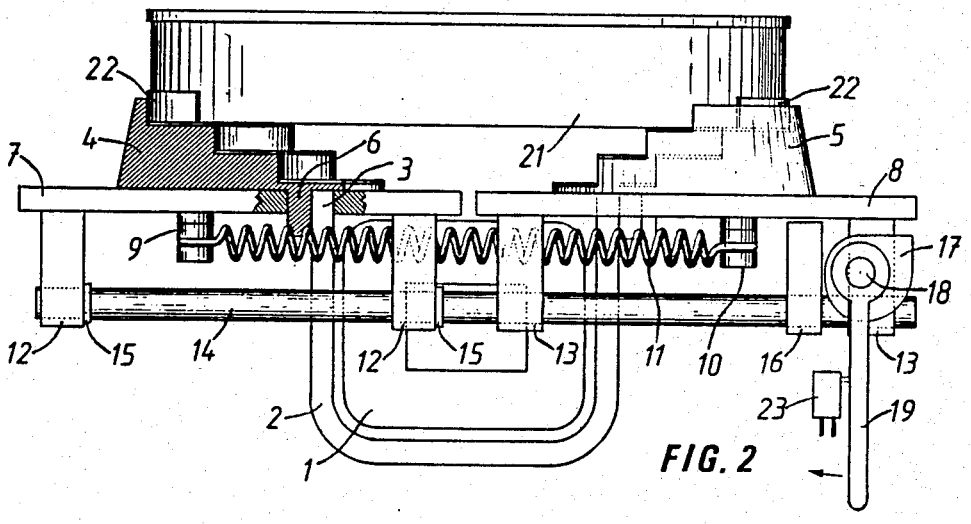
FIG. 2 is a view similar to FIG. 1 illustrating the vessel clamped in position for heating between the electrodes.

The eccentric cam 17 has a flat area in contact with the piece 16 when in the position of FIG. 1 and this contact maintains the electrodes 4 and 5 in the open position ready to receive the vessel 21. Once the vessel 21 has been placed between the electrodes 4 and 5, the lever 19 is rotated in a clockwise direction as indicted by the arrow in FIG. 2, and the draw spring 11 is permitted to pull the respective coupling pins 9 and 10 toward each other to forcefully press the electrodes 4 and 5 against the vessel 21 so as to clamp the vessel firmly in place between the electrodes as shown in FIG. 2.

Highly conductive, metal contact pieces 22 are welded to diametrically opposite sides of the vessel to provide large electrical contact areas adapted to be engaged with the electrodes 4 and 5 which are pressed tightly against the contacts by the draw spring 11. In this clamped or closed position as shown in FIG. 2, the action of the draw spring 11 is not now counteracted by the eccentric cam 17, and the spring is free to exert full force.

Figure 3:
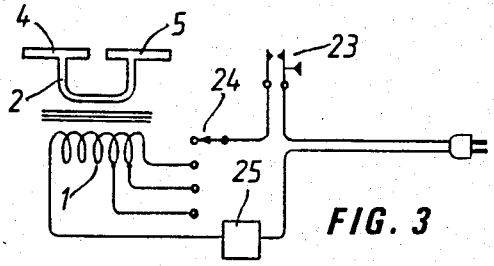
FIG. 3 is a diagrammatic illustration of an electric circuit in accordance with the system of the present invention.

Upon pivoting the lever 19 to the end of a clamping stroke, a switch contact 23 is activated by the lever to close an electrical circuit as shown in FIG. 3 to energize the primary of the transformer 1. Heat instantly begins to be generated in the metal of the vessel 21 and the temperature of the vessel which will not exceed the boiling point of the liquid contained in the vessel begins to rise.

As can be seen, the electrodes 4 and 5 have a stepped or graded structure so that vessels of different sizes can be used in the system.

The coupling pins 9 and 10 or at least one of them, is made out of electrically insulating material in order to prevent the draw spring 11 from closing the electric circuit of the secondary 2. It should also be observed that the mechanical components which are fastened to the plates 7 and 8 and which we have made reference to are duplicated, in other words, a set of components identical to the one represented in FIGS. 1 and 2 is located to the rear or behind the ones shown in FIGS. 1 and 2.

As shown in FIG. 3, the transformer includes a primary 1 and a secondary winding 2 connected to the electrodes 4 and 5. In order to be able to adjust the temperature generated inside the vessel 21, the primary 1 has several current connector contacts that can be selected by means of a switch 24. The switch 23 of FIG. 3 is also represented in FIGS. 1 and 2, and this switch closed when the control lever 19 reaches the end of a clockwise stroke.

For the purpose of checking to see whether or not the vessel 21 has been clamped tightly in the right position with good electrical contacts, an ammeter 25 is provided in the circuit for indicating the operating current in the primary system.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. An electromechanical system for generating heat in metallic vessels, comprising:

an electrically conductive vessel which acts as a load resistance for the secondary of a transformer, a transformer having a secondary providing a low voltage and a high current related to match the ohmic value of said vessel in response to the power that is to be dissipated in said vessel as heat, said vessel having contact members on opposite sides for receiving the voltage developed in the secondary of said transformer and applied to the vessel, conductive electrodes connected to said transformer secondary adapted to directly engage said contact members on said vessel, pressure means acting on said electrodes normally biasing said electrodes to approach each other to establish pressure contact with said contact members of said vessel when said vessel is placed in an operative position between said electrodes for heating, mechanical means for controlling the action of said pressure means allowing pressure therefrom to be exerted or neutralized, and when neutralized providing separation of said electrodes for allowing said vessel in which heat is to be generated to be removed from or placed between said electrodes, and circuit means for closing an electric circuit for energizing said transformer to generate said secondary current for passage through said vessel after placement in said operative position clamped between said electrodes.

2. The system of claim 1 wherein said vessel in which said heat is to be generated is made out of metal having a resistivity higher than the resistivity of a good conductor, and wherein said contact members are formed of highly conductive material welded to said vessel over relatively a large area upon which said electrodes press for directing a flow of electric current through said contact members to heat the vessel.

3. The system of claim 2 wherein said contact members on said vessel and said electrodes have matching contact surfaces for providing a substantially uniform flow of current therebetween over said surfaces when said electrodes are pressed against said contact members of said vessel in said operative position.

4. The system of claim 1 wherein said electrodes are made out of highly conductive material and have stepped faces for contacting said contact pieces on said vessel, opposed pairs of steps on said electrodes having a different spacing therebetween corresponding to vessels having a different dimension.

5. The system of claim 1 wherein said Pressure means urging said electrodes to press against said vessel includes at least one tension spring having opposite ends fastened adjacent said electrodes urging said electrodes toward one another.

6. The system of claim 1 wherein said mechanical means includes a pair of support plates carrying said electrodes and mounted for reversible motion of approach and separation along a plane, said mechanical means including a guide bar interconnecting said support plates for said reversible motion, said pressure means biasing said support means toward one another, and an eccentric cam rotatable to move said support plates apart against the action of said pressure means.

7. The system of claim 6 wherein said mechanical means of control includes a lever rotatable with a stroke of 180°, one end of said stroke corresponding to a position of maximum separation between said electrodes, and said lever rotatable toward an opposite end of said stroke while turning said eccentric cam to permit said pressure means to move said electrodes toward each other and press against contact members on a vessel placed in said operative position between said electrodes.

8. The system of claim 7 wherein said circuit means includes a switch for energizing said transformer actuated by movement of said lever to said opposite end of said stroke.

9. The system of claim 1 wherein said circuit means includes a measuring instrument responsive to the level of energy dissipated in said vessel.

10. The system of claim 9 wherein said measuring instrument is connected with a primary of said transformer.

11. The system of claim 1 wherein said circuit means includes a switch selectively connectable with one of several windings of a primary of said transformer for regulating the energy to be dissipated as heat in said vessel while in said of operative position between said electrodes.

* * * * *